US005482334A

United States Patent [19]

Hötzl

[11] Patent Number: 5,482,334

[45] Date of Patent: Jan. 9, 1996

[54] HANDLE ASSEMBLY FOR DUAL-STEM DOOR LOCK

[75] Inventor: Manfred Hötzl, Graz, Austria

[73] Assignee: Roto Frank Eisenwarenfabrik Aktiengesellschaft, Karisdorf bei Graz, Australia

[21] Appl. No.: 132,450

[22] Filed: Oct. 6, 1993

[30] Foreign Application Priority Data

Oct. 6, 1992 [AU] Australia ..... 1965/92

[51] Int. Cl.[6] ..... E05B 15/02

[52] U.S. Cl. ..... 292/357; 292/DIG. 53; 292/DIG. 30; 292/348; 292/DIG. 27; 292/142; 70/107

[58] Field of Search ..... 70/107, 111, 488, 70/DIG. 32, DIG. 31, DIG. 12; 292/348, 347, DIG. 27, 357, DIG. 53, DIG. 54, DIG. 30, DIG. 51, 172, 142

[56] References Cited

U.S. PATENT DOCUMENTS

| | | | |
|---|---|---|---|
| 1,788,287 | 1/1931 | Flagg | 292/DIG. 27 |
| 1,911,648 | 5/1933 | Rightmyer | 292/172 |
| 1,968,285 | 7/1934 | Egan | 292/DIG. 27 |
| 2,854,277 | 9/1958 | Erkkila | 292/348 |
| 3,791,180 | 2/1974 | Doyle | 70/107 |
| 3,839,886 | 10/1974 | Watson | 70/134 |
| 4,058,333 | 11/1977 | Roe et al. | 292/142 |
| 4,384,465 | 5/1983 | Muus | 292/DIG. 27 |
| 4,606,203 | 8/1986 | Esser | 70/107 |
| 4,809,526 | 3/1989 | Shen | 70/107 |
| 4,934,800 | 6/1990 | Choi | 292/172 |
| 5,060,991 | 10/1991 | Davidian et al. | 292/172 |
| 5,284,450 | 10/1994 | Swanberg | 292/DIG. 27 |

FOREIGN PATENT DOCUMENTS 7327872 2/1975 France .

*Primary Examiner*—Darnell M. Boucher
*Attorney, Agent, or Firm*—Herbert Dubno; Andrew Wilford

[57] ABSTRACT

A door lock having upper and lower vertically spaced actuator seats centered on respective vertically spaced upper and lower axes has a handle assembly having inner and outer mounting plates horizontally flanking the door lock. An upper stem fitted in the upper actuator seat and supported on the inner plate can rotate about the upper actuator axis and carries an inner handle. A lower stem fitted in the lower actuator seat and supported on the outer plate can rotate about the lower axis. An outer stem separate from the inner stem and supported on the outer plate can rotate about the upper axis coaxially with the inner stem and carries an outer handle. Gearing interconnects the outer and lower stems for rotation of the lower stem about the lower axis on rotation of the outer stem about the upper axis.

6 Claims, 1 Drawing Sheet

HANDLE ASSEMBLY FOR DUAL-STEM DOOR LOCK

FIELD OF THE INVENTION

The present invention relates to a dual-pinion or dual-stem door lock. More particularly this invention concerns a handle or actuator assembly for such a lock.

BACKGROUND OF THE INVENTION

A dual-pinion or dual-stem door lock has a pair of normally vertically offset pinions in which can be seated respective stems for respective door handles or actuators. In a standard installation one of the stems, the one that carries the inside door handle, is coupled to the bolt operated by the lock so that it can always retract this bolt. The other stem carries the outside door handle and can be blocked or disconnected from the door-bolt so that the door can be locked. Thus a door equipped with such a latch can always be opened from inside, but can be locked from the outside. Typically a key-operated mechanism provided underneath the outside door stem serves to couple and decouple the outside handle from the operating mechanism of the lock.

Thus with such a lock one of the door handles or knobs is typically mounted at a lower level than the handle on the opposite face of the door. This not only looks odd when the door is seen from the edge, but is counter to standard good design practices which mandate a regulation height for door handles. What is more if the lock is installed such that the outside handle is the lower handle, there is frequently insufficient clearance underneath the outside handle to get to the key, making its use difficult.

French patent 2,239,894 describes a handle-actuating assembly that can be installed on a door to displace the door handle or knob horizontally away from the edge of the door. Such an assembly is used on a conventional latch and constitutes an ugly attachment to the otherwise neat lock. It adds no extra functionality to a dual-pinion door lock.

OBJECTS OF THE INVENTION

It is therefore an object of the present invention to provide an improved handle actuating assembly for a dual-pinion door lock.

Another object is the provision of such an improved handle actuating assembly for a dual-pinion door lock which overcomes the above-given disadvantages, that is which allows both door handles to be at the same level, which is extremely neat in appearance and simple in construction, and that in particular accommodates the particular functions of a dual-stem door lock.

SUMMARY OF THE INVENTION

A door lock having upper and lower vertically spaced actuator seats centered on respective vertically spaced upper and lower axes has according to the invention a handle assembly having inside and outside mounting plates horizontally flanking the door lock. An inside stem fitted in the upper actuator seat and supported on the inside plate can rotate about the upper actuator axis and carries an inside handle. A lower stem fitted in the lower actuator seat and supported on the outside plate can rotate about the lower axis. An outside stem separate from the inside stem and supported on the outside plate can rotate about the upper axis coaxially with the inside stem and carries an outside handle. Gearing interconnects the lower and outside stems for rotation of the lower stem about the lower axis on rotation of the outside stem about the upper axis.

Thus with this system both handles are movable about the same axis, as in a standard single-stem lock. The lock looks normal and there is ample room under the outside handle to gain access to the keyhole that is normally provided there, or under the inside handle to get to the control button. Nonetheless the advantages of the known dual-stem locks are retained.

According to a further feature of this invention the gearing includes respective pinions on the inside and outside stems, a rack meshing with the pinions, and a guide in one of the plates permitting the rack to slide while in mesh with the pinions as the pinions rotate. In fact two such racks can be provided, both guided in a housing formed by the outside plate.

Furthermore in accordance with this invention the inside stem is supported in the outside plate in a Journal for rotation about the upper axis. This support means for the inside stem is carried on the outside stem. Furthermore means is provided on the inside plate for supporting the lower stem for rotation about the lower axis. This ensures that neither of the inside or lower stems gets canted and that the handles have the solid feel of a single-stem lock.

BRIEF DESCRIPTION OF THE DRAWINGS

The above and other objects, features, and advantages will become more readily apparent from the following description, reference being made to the accompanying drawing in which.

SPECIFIC DESCRIPTION

Figure 1:
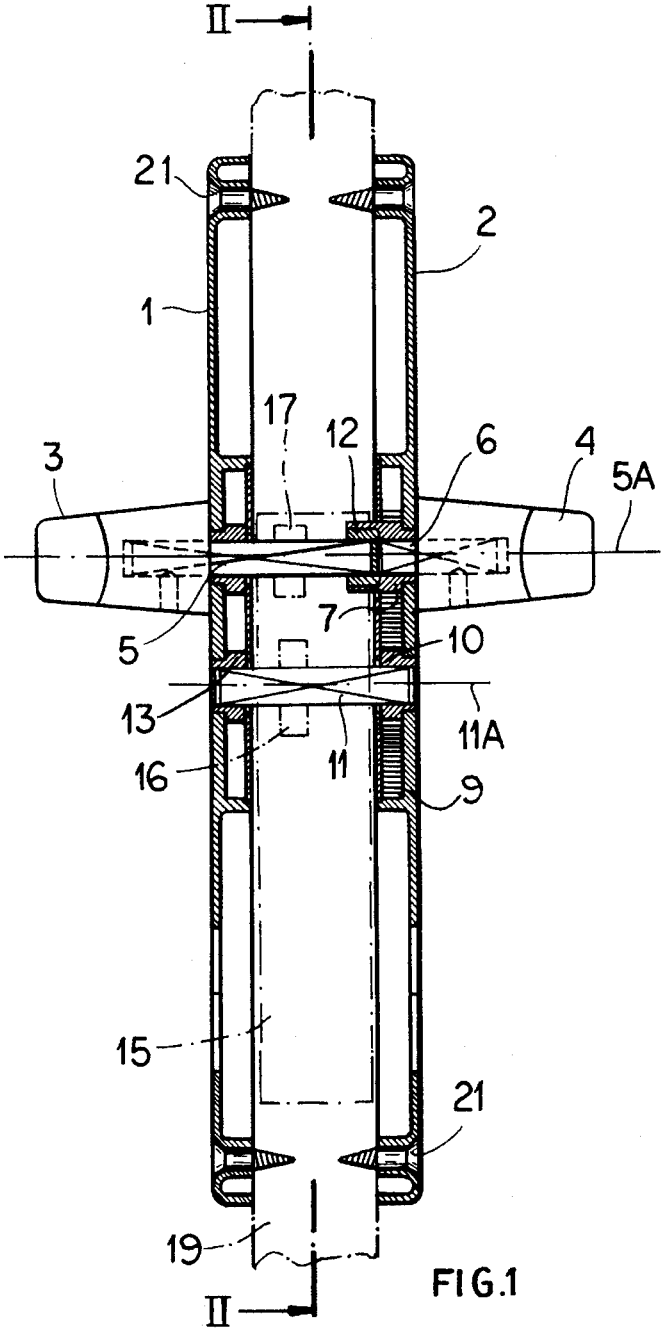
FIG. 1 is a vertical section through the handle assembly according to the invention.

As shown in dot-dash lines in the drawing, a door 19 is provided at one edge with a mortised lock 15 having a pair of vertically spaced seat-forming actuating pinions 16 and 17. The upper pinion 17 is permanently connected via an unillustrated mechanism in the lock 15 to a door bolt 18 but the connection between the lower pinion 16 and the bolt 18 can be interrupted by an unillustrated key-operated mechanism. This structure is well known in the art.

According to the invention the opposite faces of the door 19 are fitted with a pair of externally identical plates or escutcheons 1 and 2 that are held in place by screws 21, that extend vertically over the lock 15, and that have keyholes 20 aligned with the unillustrated key mechanism of the latch. The inside plate i carries a square-section rod or stem 5 extending along an upper axis 5A and on which is mounted an inside door handle 3, here of the lever type, with the inside stem 5 fitted in the nut or pinion 17 to rotate same. The outer end of the stem 5 is carried in a seat 12 of the outside plate 2 to keep this stem 5 square to the latch without coupling it rotationally to any mechanism on the outside plate 2.

Figure 2:
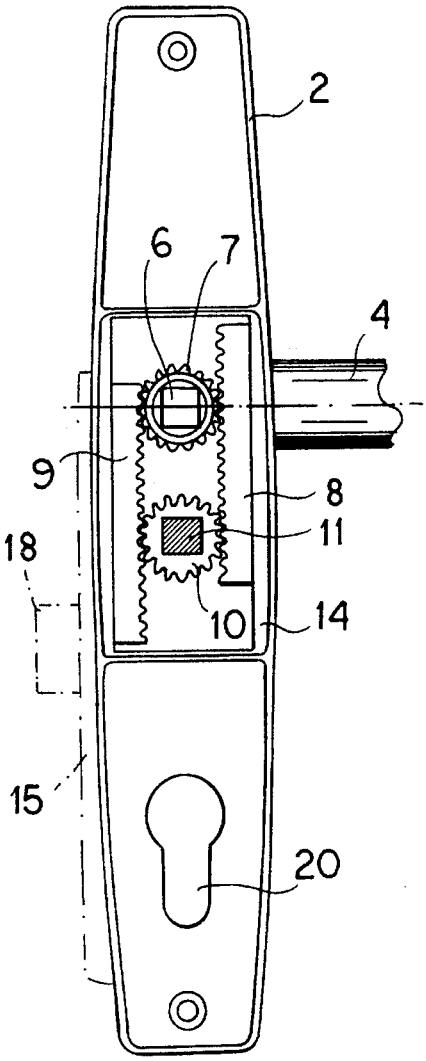
FIG. 2 is a section taken along line II—II of FIG. 1.

This outside plate 2 carries as best seen in FIG. 2 upper and lower gears 7 and 10 coaxial with the pinions 17 and 16 and a pair of racks 8 and 9 vertically slidable in guides 14 formed by the plate 2 to rotationally couple these gears 7 and 10 together for joint codirectional rotation. The upper gear 7 is fitted with an outside 6 coaxial with the inside stem 5 and carrying an outside door handle 4 that, therefore, is exactly level with the inside handle 3. The lower gear 10 is fitted with a stem 11 that is fitted through the lower lock pinion 16 and whose inside end is received in a seat 13 provided on the inside plate 1. This seat 13, like the seat 12, permits the stem 11 to rotate and serves to keep it aligned. The seat 12 is carried on the gear 7 but can rotate relative to it.

Thus with the system of this invention the two handles 3 and 4 are in perfect alignment with each other. There is therefore plenty of room underneath the outside handle 4 for access to the keyhole 20 and the assembly presents a standard appearance, even though it has a dual-actuator lock 15.

I claim:

1. In combination with a door lock having upper and lower vertically spaced actuator seats centered on and rotatable independently of each other about respective vertically spaced upper and lower axes, a handle assembly comprising:

outside and inside mounting plates horizontally flanking the door lock;

an inside stem fitted in the upper actuator seat and supported on the inside plate for rotation about the upper actuator axis;

an inside handle carried on the inside stem;

a lower stem fitted in the lower actuator seat and supported on the outside plate for rotation about the lower axis;

an outside stem separate from the inside stem and supported on the outside plate for rotation about the upper axis coaxially with the inside stem;

an outside handle carried on the outside stem; and gearing interconnecting the lower and outside stems for rotation of the lower stem about the lower axis on rotation of the outside stem about the upper axis, the gearing including respective upper and lower gears on the outside and lower stems, a rack meshing with the upper and lower gears and a guide in one of the plates permitting the rack to slide while in mesh with the gears as the gears rotate.

2. The handle assembly defined in claim 1, further comprising:

means on the outside plate supporting the inside stem for rotation about the upper axis.

3. The handle assembly defined in claim 2 wherein the support means for the inside stem is carried on the outside stem.

4. The handle assembly defined in claim 1, further comprising means on the inside plate supporting the lower stem for rotation about the lower axis.

5. The handle assembly defined in claim 1 wherein the outside plate forms a housing for the gearing.

6. The handle assembly defined in claim 1 wherein the lower axis is below the upper axis.

* * * * *